US006205649B1

(12) United States Patent
Clayton et al.

(10) Patent No.: US 6,205,649 B1
(45) Date of Patent: Mar. 27, 2001

(54) METHOD OF MAKING A CERAMIC HEATER WITH PLATINUM HEATING ELEMENT

(76) Inventors: Mark A. Clayton, 507 Foxbound Rd., Simpsonville, SC (US) 29680; Garry L. Renner, 4037 Calboun Memorial Hwy., Easley, SC (US) 29640; Mark J. Cresanti, 108-A Commerce Dr., Greer, SC (US) 29650-1220

( * ) Notice: Subject to any disclaimer, the term of this patent is extended or adjusted under 35 U.S.C. 154(b) by 0 days.

(21) Appl. No.: 09/323,667

(22) Filed: Jun. 1, 1999

(51) Int. Cl.[7] ..... H05B 3/00
(52) U.S. Cl. ..... 29/611; 219/548
(58) Field of Search ..... 219/553, 548, 219/543, 552, 270; 29/611, 620, 621; 338/262, 275, 321, 333, 306–309; 428/446; 75/238

(56) References Cited

U.S. PATENT DOCUMENTS

| | | | | |
|---|---|---|---|---|
| 3,870,776 | | 3/1975 | McMahon . | |
| 4,507,191 | | 3/1985 | Ebizawa et al. . | |
| 4,549,905 | * | 10/1985 | Yamaguchi et al. | 75/238 |
| 4,804,823 | | 2/1989 | Okuda et al. . | |
| 4,935,289 | | 6/1990 | Kikuchi et al. . | |
| 4,952,903 | | 8/1990 | Shibata et al. . | |
| 5,233,166 | * | 8/1993 | Maeda et al. | 219/552 |
| 5,279,886 | | 1/1994 | Kawai et al. . | |
| 5,314,850 | | 5/1994 | Miyahara . | |
| 5,372,666 | | 12/1994 | Kawasaki . | |
| 5,468,936 | | 11/1995 | Deevi et al. . | |
| 5,683,606 | | 11/1997 | Ushikoshi et al. . | |
| 5,753,893 | * | 5/1998 | Noda et al. | 219/548 |
| 5,756,215 | * | 5/1998 | Sawamura et al. | 428/446 |
| 5,877,474 | * | 3/1999 | Konishi | 219/270 |
| 6,013,903 | * | 2/2000 | Mifune et al. | 219/552 |

* cited by examiner

*Primary Examiner*—Teresa Walberg
*Assistant Examiner*—Quang Van

(57) ABSTRACT

A ceramic heater which has an alumina rod, an alumina based ribbon sintered to the rod, and a platinum resistor element bonded to the ribbon. Additionally, a method of making a ceramic heater by preparing a ceramic slurry; combining the ceramic slurry with a binder component to form a slip; depositing the slip onto a carrier film at a controlled thickness such that a deposited slip is formed; heat curing the deposited slip to form a cured slip ribbon; applying a platinum paste onto the ribbon in a specific pattern, the paste forming a platinum resistor element on the ribbon; applying the ribbon with the platinum resistor element onto an alumina rod; and, heating the rod with the ribbon and the platinum resistor element thereon, whereby the ribbon is sintered to the rod and the platinum resistor element is sintered and bonded to the ribbon.

7 Claims, 6 Drawing Sheets

METHOD OF MAKING A CERAMIC HEATER WITH PLATINUM HEATING ELEMENT

FIELD OF THE INVENTION

The present invention relates generally to ceramic heaters and more particularly to a ceramic heater having a platinum heating element which is resistent to oxidation.

BACKGROUND OF THE INVENTION

Ceramic heaters are generally known in the art. Normally, a ceramic heater will include an insulating portion, a heat generating portion, and electrical lead portions formed integrally with a ceramic body or substrate. The heater element and lead portions are normally formed of a single electrically conductive metal such as an inexpensive non-noble or base metal such as tungsten and molybdenum. However, the heater element and lead portions made of such metals are prone to oxidize during long periods of use at high operating temperatures in oxidizing atmospheres such as air. The oxidation may result in disconnection of the heat-generating portion of the ceramic heater and, thus, heater failure.

The art has sought to solve this problem by decreasing the amount of non-noble or base metal used in the ceramic heater. For example, U.S. Pat. No. 4,952,903 to Shibata et al., (hereinafter "Shibata") teaches a ceramic heater including a ceramic body and a heater element formed of a cermet containing a ceramic material and a metal material which principally consists of at least one noble metal; and, including electrical lead portions formed of a metallic material consisting of at least one base metal or formed of a cermet containing ceramic material and metallic material. Shibata mentions the making of the heater element from a noble metal such as platinum or rhodium, but dismisses such use because of costs and the difficulty of bonding a noble metal to a ceramic substrate. The use of such noble metal would overcome the problems associated with oxidation of the metal. Thus, an economic and practical means of using such noble metals would be advantageous to the art of ceramic heaters. For these reasons, there remains room for improvement in the art.

SUMMARY OF THE INVENTION

It is an object of this invention to provide adequate binding of noble metals to a ceramic substrate.

It is also an object of this invention to provide a ceramic heater which does not require an outer sheath or cover and which is economical to manufacture.

It is another object of the present invention to provide a method of making a ceramic heater which provides for the screen printing of the heater element onto a ceramic sheet.

It is a further object of the present invention to provide a method of making a ceramic heater which does not require a cover layer to protect the heating element.

These and other objects of the invention are achieved by a ceramic heater comprising an alumina rod, an alumina based ribbon sintered to the rod, and a platinum resistor element bonded to the ribbon. These and other objects are also achieved by a method of making a ceramic heater comprising the steps of making a ceramic slurry; combining the ceramic slurry with a binder component to form a slip; depositing the slip onto a carrier film at a controlled thickness such that a deposited slip is formed; heat curing the deposited slip to form a cured slip ribbon; applying a platinum paste onto the ribbon in a specific pattern, the paste forming a platinum resistor element on the ribbon; applying the ribbon with the platinum resistor element onto an alumina rod; and, heating the rod with the ribbon and the platinum resistor element thereon, whereby the ribbon is sintered to the rod and the platinum resistor element is sintered and bonded to the ribbon.

DETAILED DESCRIPTION OF THE INVENTION

Figure 1:
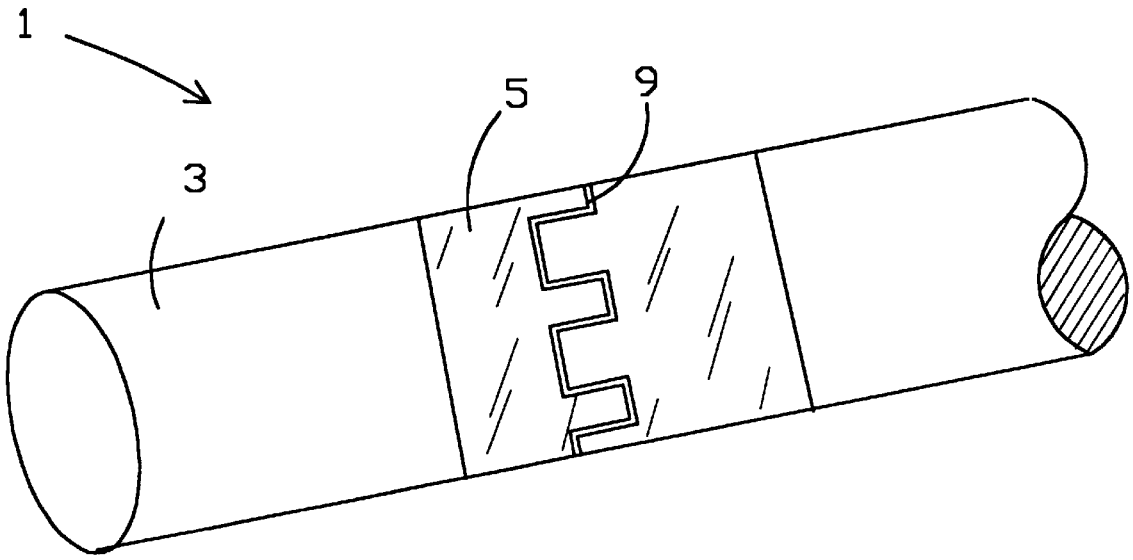
FIG. 1 is a perspective view of the ceramic heater of the present invention.

FIG. 1 is a perspective view of the ceramic heater of the present invention. As shown, the ceramic heater comprises a rod portion 3 which is preferably an alumina rod but can comprise any suitable insulating material. Alumina is preferable in this instance because of its physical and thermal robustness. Also, as shown, the resistor element 9 is printed onto a cured slip ribbon 5 which is in communication with the alumina rod 3; however, the resistor element 9 may be screen printed directly onto the rod 3 (not shown). In a preferred embodiment, the resistor element 9 is made from a platinum paste but may comprise some other noble metal or combination comprising a noble metal. The resistor element 9 is sintered and bonded onto the ribbon 5 which is further sintered onto the alumina rod 3 to form the ceramic heater 1. In certain instances, however, it may be preferable to sinter or bond the resistor element 9 directly onto the rod 3 using the method of this invention without involving the ribbon element 5.

Figure 2:
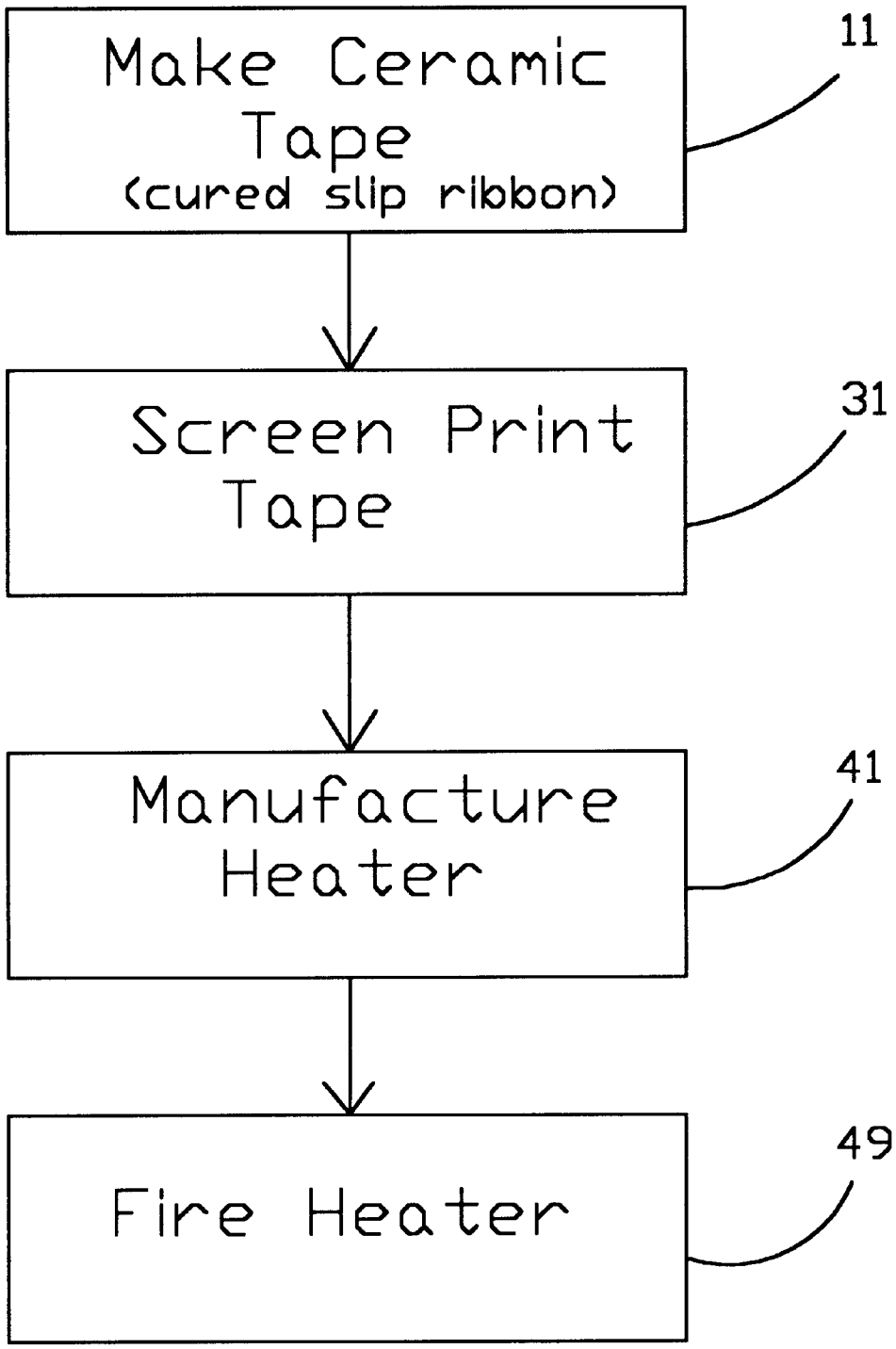
FIG. 2 is a schematic representation of the method of making the ceramic heater of the present invention.

FIG. 2 is a schematic representation of the method by which the ceramic heater 1 of the present invention is made. The first step 11 in making the ceramic heater 1 is to make the ceramic tape or the cured slip ribbon 5. The second step 31 includes screen printing the resistor element 9 onto the ribbon 5. The third step 41 includes manufacturing the heater 1. And the final step 49 involves bonding and sintering the heater elements and the ceramic particles together. These steps will be described in more detail below.

Figure 3:
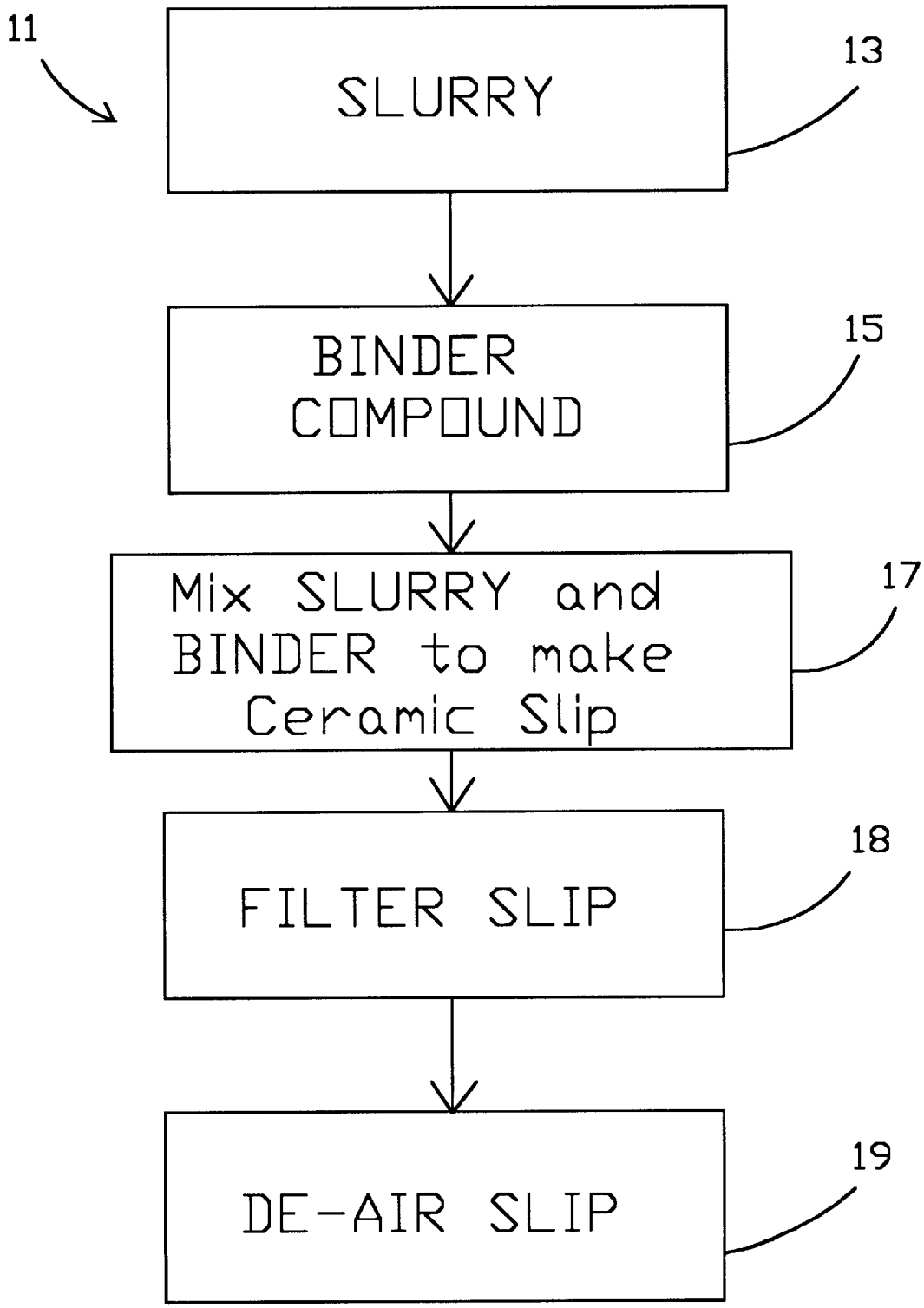
FIG. 3 is a schematic representation of the method of making the slip of the present invention.

The first step 11 is more fully detailed with reference to FIG. 3. FIG. 3 is a schematic representation of the method of making the cured slip ribbon 5 of the present invention. In making the ceramic slurry 13 used in the present invention, dried ceramic powders, such as $Al_2O_3$, MgO, $SiO_2$, $ZrO_2$ and $CaCO_3$, are weighed, blended and then wet out by conventional means to form the slurry 13. The ceramic components to the slurry 13 are mixed by conventional means, for example in mixing tanks, for approximately one hour to ensure consistency in the mixture. Thereafter, the slurry 13 is transferred into the vibratory mill where the ceramic particles are broken down to create more surface area. The process of breaking down the ceramic particles makes the alumina in the slurry 13 more reactive and, thus, allows for a lower sintering temperature. Second, the breaking down process allows the forming of a ceramic tape comprising more densely packed particles which reduces variability throughout the ceramic tape or ribbon 11.

Once the milling process is completed, the slurry 13 is removed from the vibratory mill and returned into the mixing tanks where the weight is recorded and used to calculate the proper binder addition. Once the proper binder addition is calculated, the slurry 13 is combined with a binder compound 15 to produce the ceramic slip 17. In a preferred embodiment of the invention, the binder 15 is a cellulose binder compound. The method of the present invention is to manufacture the binder compound 15 by combining the necessary raw materials and "cooking" the solution in a crock-pot type apparatus. By cooking the solution, materials such as polyethyleneglycol and polyvinylalcohol melt down into a viscous fluid which is then added to the slurry 13 to form the ceramic slip 17.

In a preferred embodiment of the present invention, the ceramic slip 17 formulation (by weight) will be as follows:

| | | | |
|---|---|---|---|
| $Al_2O_3$ | 51%[1] | PEG 3350 | 0.5% |
| $H_2O$ | 40% | PEG 8000 | 0.5% |
| PVA | 3% | Darvan 821A | 0.4% |
| Glycerol | 1.9% | MgO | 0.4% |
| $SiO_2$ | 1.6% | $ZrO_2$ | 0.1% |
| $CaCO_3$ | 0.6% | | |

[1]The weights identified in this formulation are approximate weights.

After the addition of the binder 15, the ceramic slip 17 is mixed for approximately one hour. The slip 17 is then pumped through a series of filters 18, for example fiber woven filters, and into at least one slip casting tank. The filtration process removes excessively large particles or conglomerates to ensure consistency. The slip 17 is then de-aired 19 in the casting tank for approximately twelve (12) hours. During this time, the slip 17 is kept in suspension by slow rotation of the mixing blade. This allows any entrapped air to escape from the slip 17 so that pinholes will not form when casting the ribbon 27.

Figure 4:
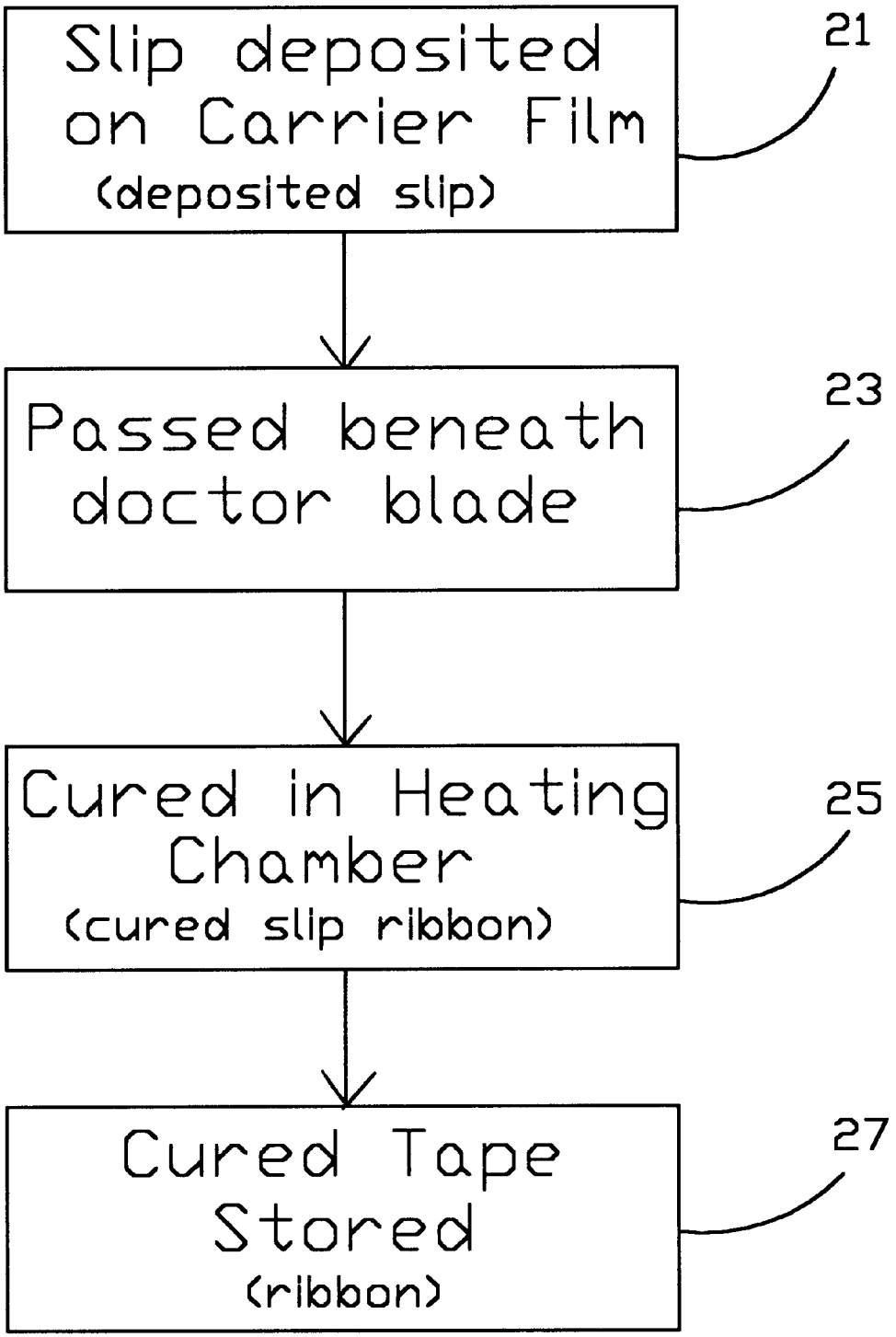
FIG. 4 is a schematic representation of the method of making the ribbon of the present invention.

FIG. 4 is a schematic representation of the method of making the ribbon 27 of the present invention. Once the slip 17 is sufficiently processed, it is pumped from a tank, such as a casting tank, into a reservoir. A carrier film 21 is passed through the reservoir, entering one end and exiting the opposite, such that the slip composition 17 is deposited onto the carrier film 21 to make a deposited slip. The deposited slip is then brought into contact with a blade, such as a "doctor-blade" 23. In a preferred embodiment, the deposited slip travels underneath the doctor blade 23 which is positioned at a predetermined distance above the carrier film. This process controls the thickness of the slip 17 which is allowed to remain deposited on the carrier film 21 and thus controls the resulting thickness of the ceramic tape or ribbon 27.

After passing under the "doctor-blade" 23, the deposited slip is cured. In a preferred embodiment the deposited slip is cured 25 by causing the deposited slip to travel through a heated chamber where the deposited slip is dehydrated. After exiting the chamber, the cured slip or tape may be stored 27 for later use by winding up on a reel, or by any other conventional means of storage.

Figure 5:
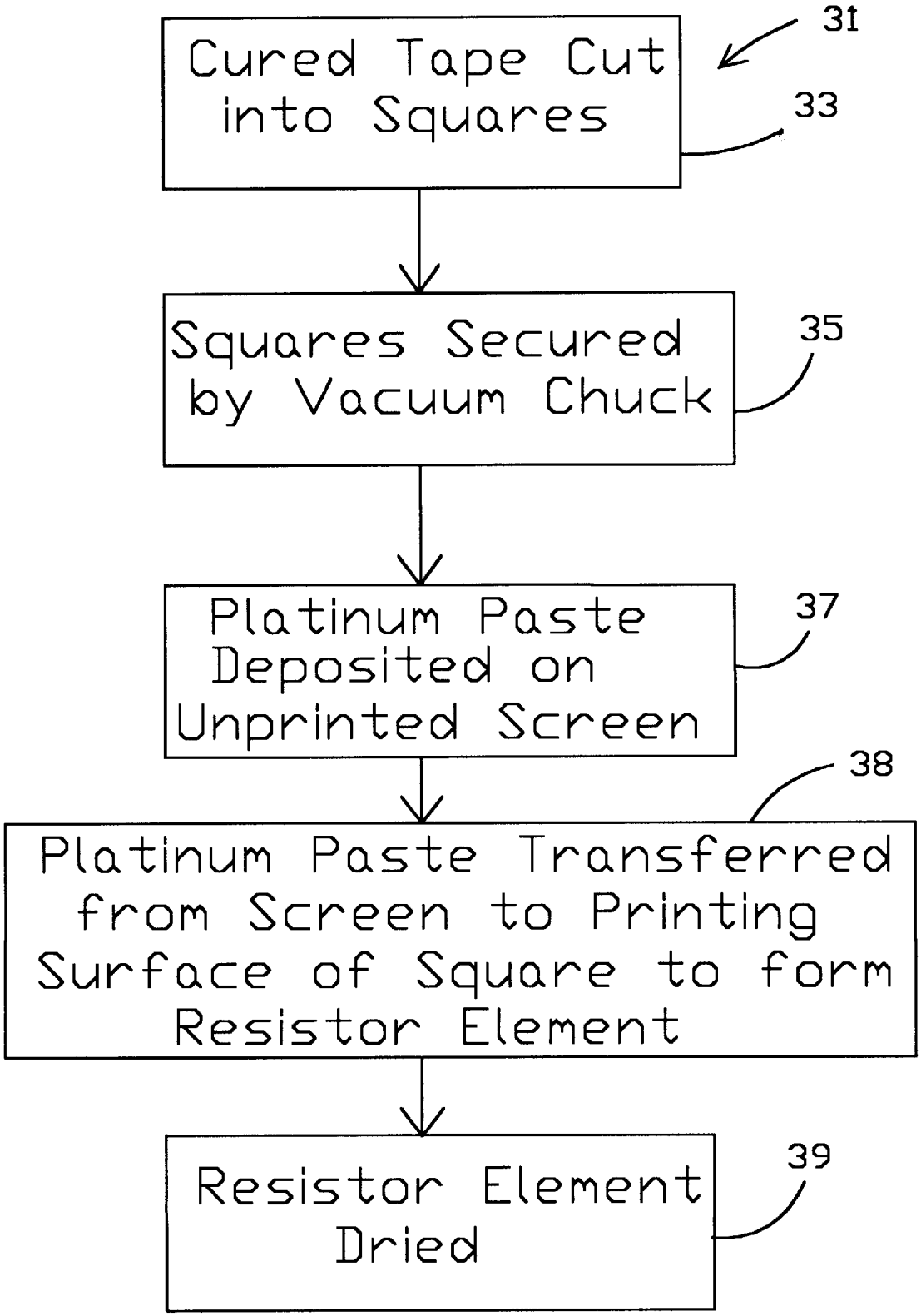
FIG. 5 is a schematic representation of the method of manufacturing the resistor element of the present invention.

FIG. 5 is a schematic representation of the method of manufacturing the resistor element of the present invention. When the user is ready to prepare 31 the heater resistor element 9, the stored slip, otherwise called the ceramic tape or ribbon 27, is prepared into sheets of predetermined size 33. In the preferred embodiment, the ceramic tape or ribbon 27 will be cut into rough squares approximately 4 inches by 4 inches. The individual sheets of ceramic tape or ribbon 27 provide a printing surface. In order to ensure consistency and accuracy, the printing surface is secured in place by a holding means 35. In the preferred embodiment, the holding means is a vacuum chuck which holds the printing surface in place during the printing process. The printing is accomplished by using a screen which is shaped having a specific patten. The pattern of the screen corresponds directly to the intended or desired shape of the resistor element 9. The screen may be held in place by a frame, such as a metal frame or by any conventional method.

A platinum paste is then made and applied to a surface of the screen 37. A device, such as a squeegee, is then used to force the paste through the screen 38 and onto the printing surface of the ribbon 27. The printing surface is then removed from the holding means and allowed to dry 39, such as in a drying box, a table, or some other flat surface, to form the resistor element.

Figure 6:
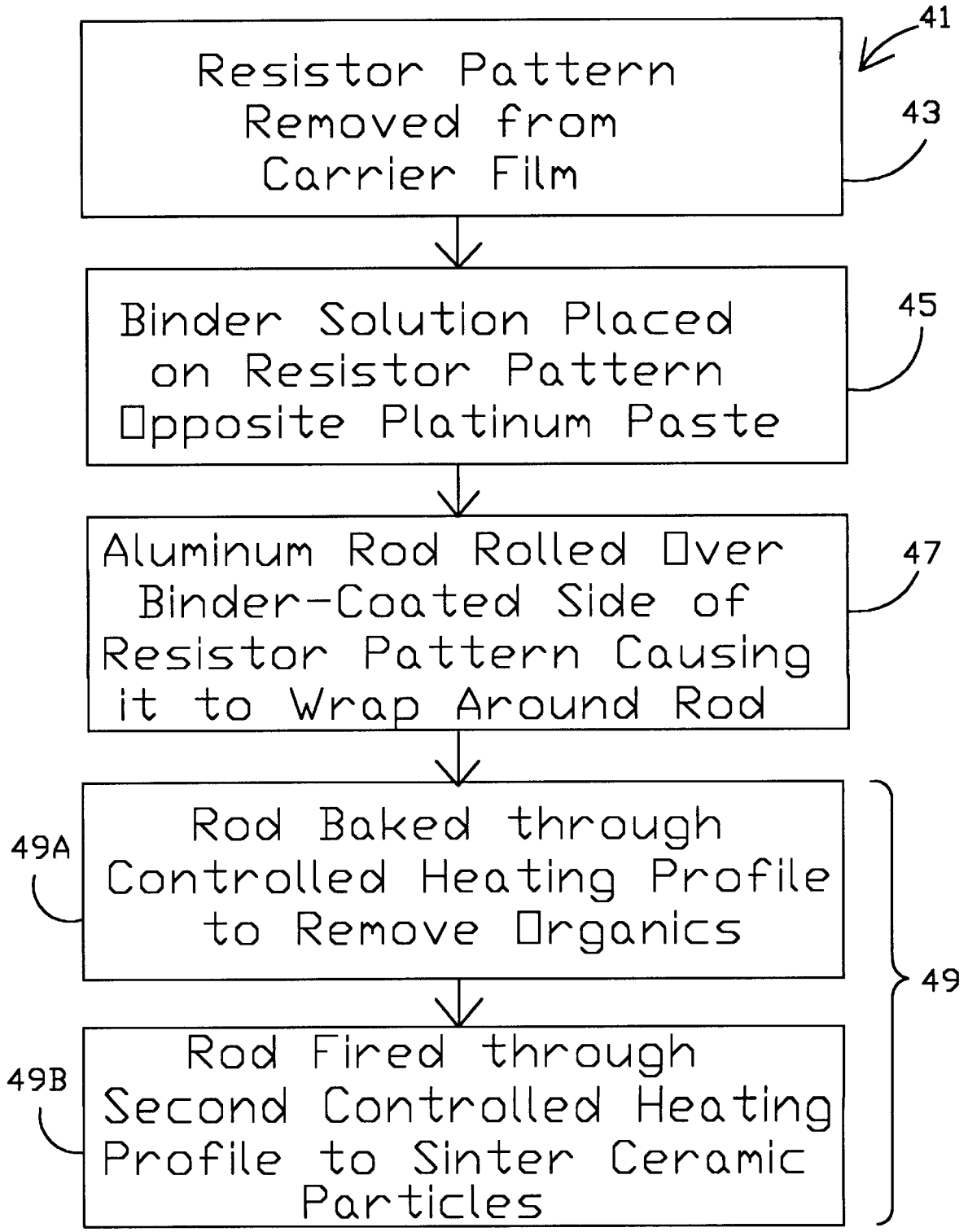
FIG. 6 is a schematic representation of the method of manufacturing the ceramic heater with the resistor element as taught in the present invention.

FIG. 6 is a schematic representation of the method of manufacturing the ceramic heater 1 with the resistor element 9 as taught in the present invention. To complete the manufacture 41 of the heater 1, the individual resistor patterns are cut out of the ribbon 27 and removed from the carrier film 43. The resistor element 9 is inverted and a binder solution is applied to a backside of the resistor element 9 opposite the platinum paste 45. The binder solution used is preferably the same alumina binder composition previously mixed with the ceramic solution to form the slip 17, but may be any equivalent binder solution. The resistor element is then applied to a pre-fired alumina rod. In a preferred embodiment, the resistor element 9 is applied by rolling 47 the rod 3 over the side of the resistor element 9 containing the binder solution, causing the resistor element 9 to wrap itself round the rod 3 to form the "green" heater.

The "green" heater is inspected to ensure a smooth and uniform wrap of the resistor element 9 to the rod 3. Once inspected, the "green" heater is "baked-out" to remove any organic materials from the heater components 49A and to center the ceramic particles. The heater 1 is heated through a controlled heating profile which is completed at approximately 625° Celsius. After the heater completes the "bake-out" phase 49A, it is then "fired" by going through a second controlled heating profile 49B which is completed at approximately 1550° Celsius.

The heater 1 that is produced in accordance with this invention having the platinum resistor element 9 (or heating element) overcomes the problems of the prior art because it is economical to produce and will not oxidize when exposed to air; thus, there is no need for an outer sheath or cover element. The method of the present invention allows for dense packing of particles while forming the ceramic tape or ribbon, reducing variability throughout the ceramic tape. The method further provides for the screen printing of the heater element onto a ceramic tape in a desired pattern.

It will be readily understood by those persons skilled in the art that the present invention is susceptible of broad utility and application. Many embodiments and adaptations of the present invention other than those described, as well as many variations, modifications and equivalent arrangements will be apparent from or reasonably suggested by the present invention and foregoing description thereof, without departing from the substance or scope of the present invention as defined by the following appended claims.

We claim:

1. A method of making a ceramic heater comprising the steps of:

a) making a ceramic slurry;

b) combining said ceramic slurry with a binder component to form a slip, said slip consisting essentially of the following constituents: $Al_3$, $O_3$, $H_2O$, PVA, Glycerol, $SiO_2$, $CaCO_3$, PEG 3350, PEG 8000, Darvan 821A, MgO, and ZnO;

c) depositing said slip onto a carrier film at a controlled thickness such that a deposited slip is formed;

d) heat curing said deposited slip to form a cured slip ribbon;

e) applying a platinum paste onto said ribbon in a specific pattern, said paste forming a platinum resistor element on said ribbon;

f) applying said ribbon with said platinum resistor element onto an alumina rod; and, g) heating said rod with said ribbon and said platinum resistor element thereon, whereby said ribbon is sintered to said rod and said platinum resistor element is sintered and bonded to said ribbon.

2. The method of making a ceramic heater according to claim 1, wherein said step of making further includes placing said slurry into a vibrating mill.

3. The method of making a ceramic heater according to claim 1, wherein said binder component is a viscous fluid.

4. The method of making a ceramic heater according to claim 1, wherein said step of depositing further comprises passing said deposited slip adjacent a blade, said blade set at a predetermined distance from a surface of said carrier film.

5. The method of making a ceramic heater according to claim 1, wherein said step of applying said platinum paste further comprises the steps of:

cutting said cured slip into a predetermined shape;

securing said cured slip by a holding means to provide a printing surface;

placing said platinum paste onto a screen surface, said screen surface having said specific pattern;

forcing said platinum paste from said screen surface onto said printing surface; and, drying said platinum paste.

6. The method of making a ceramic heater according to claim 1, wherein said step of applying said ribbon with said platinum resistor element further comprises the steps of:

applying a binder solution to a side of said ribbon opposite said resistor element whereby a means for adhering said ribbon to said rod is provided;

wrapping said ribbon around said alumina rod such that said binder solution is in communication with said alumina rod and said resistor element on said ribbon is consistently applied to said rod;

heating said alumina rod with said ribbon and said resistor element in a controlled manner such that a heater is formed.

7. A method of making a ceramic heater comprising the steps of:

processing a ceramic slurry such that ceramic particles in said slurry are broken down to create greater surface area in said slurry;

combining said ceramic slurry with a binder component to form a slip, said slip having a predetermined formulation;

pumping said slip through at least one filter such that large particles are removed;

removing air from said slip;

depositing said slip onto a carrier film at a controlled thickness such that a deposited slip is formed;

curing said deposited slip to form a cured ribbon, whereby said deposited slip is dehydrated;

applying a platinum paste onto said cured slip in a specific pattern, said paste forming a platinum resistor element;

applying said cured slip with said resistor element onto said alumina rod to form said ceramic heater; and heating said ceramic heater in a controlled manner such that organic materials are removed and ceramic particles are sintered.

* * * * *